US005507232A

United States Patent [19]

Valdez

[11] Patent Number: 5,507,232

[45] Date of Patent: Apr. 16, 1996

[54] 9 MILLIMETER CARTRIDGE CASING WITH IMPROVED DEEP DRAW CAPABILITY

[75] Inventor: Anthony F. Valdez, Godfrey, Ill.

[73] Assignee: Olin Corporation, East Alton, Ill.

[21] Appl. No.: 419,167

[22] Filed: Apr. 10, 1995

[51] Int. Cl.[6] ..... F42B 5/28

[52] U.S. Cl. ..... 102/464

[58] Field of Search ..... 102/430, 464, 102/468, 469, 470, 472

[56] References Cited

U.S. PATENT DOCUMENTS

| | | | |
|---|---|---|---|
| 190,208 | 5/1877 | Gill | 102/464 |
| 4,483,251 | 11/1984 | Spalding | 102/464 |
| 5,094,169 | 3/1992 | Evitts | 102/464 |
| 5,187,324 | 2/1993 | Ricco, Sr. | 102/464 |

FOREIGN PATENT DOCUMENTS

| | | | |
|---|---|---|---|
| 212793 | 7/1974 | U.S.S.R. | 102/430 |
| 2762 | of 1911 | United Kingdom | 102/464 |

*Primary Examiner*—Harold J. Tudor
*Attorney, Agent, or Firm*—Gregory S. Rosenblatt

[57] ABSTRACT

There is provided a single piece brass cartridge casing having improved deep drawing capability. The inner bore of the cartridge casing has a plurality of linear portions separated by at least two inflection points. A gradual change in the slope of the interior wall at each inflection point minimizes fracture at the inflection points during deep drawing.

9 Claims, 2 Drawing Sheets

9 MILLIMETER CARTRIDGE CASING WITH IMPROVED DEEP DRAW CAPABILITY

BACKGROUND OF THE INVENTION

1. Field of the Invention

This application relates to an improved 9 millimeter cartridge casing. More particularly, the inner bore contains at least two inflection points that facilitate deep drawing the cartridge casing from a brass cup.

2. Description of Related Art

A standard 9 millimeter cartridge casing has a typical length of 19 mm. To increase the power of a round, manufacturers have lengthened the casing up to 23 mm. One 9×23 mm cartridge casing is disclosed in U.S. Pat. No. 5,187,324 to Ricco, Sr. that is incorporated by reference in its entirety herein.

The Ricco, Sr. cartridge casing has a first portion, housing a powder charge and a bullet, with an outside diameter that decreases from a closed end of the portion to an open end. The inside diameter of the first portion increases from the closed end to a mid-point and then is essentially constant from the mid-point to the open end.

While the increased length of the 9×23 mm cartridge casing provides an increase in the volume of the power charge and an increase in the firing power of the round, the increased length of the casing wall causes problems with manufacture. The casing fractures at the inflection point in the inner bore of the first portion.

There exists, therefore, a need for an increased length 9 millimeter cartridge casing that is suitable for deep drawing manufacture.

SUMMARY OF THE INVENTION

Accordingly, it is an object of the invention to provide a 9 millimeter cartridge casing with the length in excess of 19 mm that is amenable to manufacture by deep drawing. It is a feature of the invention that the inside diameter of a first portion of the cartridge casing has at least two inflection points. It is another feature of the invention that the inner bore diameter of the first portion changes at a rapid rate in a rearward section and is essentially constant at a forward section. Yet another feature of the invention is that the taper of an extractor groove formed in the outside wall of the cartridge casing has a reduced angle relative to a longitudinal axis of the cartridge casing.

It is an advantage of the invention that the cartridge casing of the invention is amenable to deep drawing. Yet another advantage of the invention is that a 9 mm cartridge casing having a length in excess of 19 mm and typically on the order of 23 mm is readily formed by utilizing the concepts of the invention.

In accordance with the invention, there is provided a single piece brass cartridge casing. The cartridge casing has a first portion for receiving both gun powder and a bullet, a second portion for receiving a primer charge and a transition portion disposed between the first portion and the second portion.

The first portion has an outside diameter that continuously decreases from a maximum adjacent to the transition portion to an opposing end of the first portion. The first portion also has an inner bore that contains a first linear interior portion extending from the opposing end to a first inflection point, a second linear interior portion extending from the first inflection point to a second inflection point, a third linear portion extending from the second inflection point to a third inflection point and a fourth portion that extends from the third inflection point to a planar interior base. This planar interior base is generally perpendicular to a longitudinal axis of the cartridge.

The second portion of the cartridge has an interior chamber to receive a primer charge and the transition portion has an internal channel that extends from the first portion to the second portion.

The above stated objects, features and advantages will be more apparent from the specification and drawings that follow.

IN THE DRAWINGS

DETAILED DESCRIPTION

Figure 1:
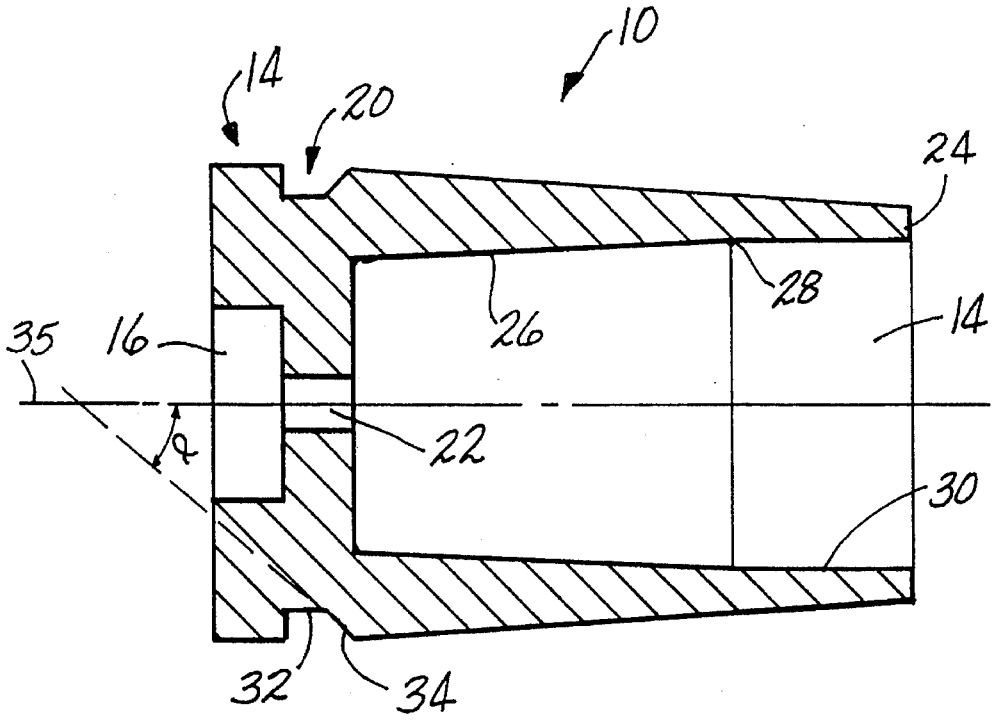
PRIOR ART FIG-1
FIG. 1 shows in cross-sectional representation a 9 millimeter cartridge in accordance with the prior art.

FIG. 1 shows in cross-sectional representation a 9×23 mm cartridge casing 10 as known from the prior art. The 9×23 mm cartridge casing is formed from a single piece of brass, typically cartridge brass (copper alloy C260 with a nominal composition, by weight, of 30% zinc and the balance copper.

The 9×23 mm cartridge casing 10 is divided into three portions, a first portion 12 contains a first inner bore 14 for receiving a gun powder charge and a bullet. Opposite the first portion 12 is a second portion 16 having a second bore 18 for receiving a primer charge. Disposed between the first portion 12 and the second portion 16 is a transition portion 20 containing an internal channel 22 that communicates the energy of the primer charge to the gun powder charge.

The outside diameter of the first portion 12 decreases from a maximum at a point adjacent to the transition portion 20 to a minimum at an opposing end 24. Typically, the outside diameter decreases from the range of 0.395 inch–0.401 inch to the range of 0.372 inch–0.380 inch.

The inner bore 14 contains a first portion 26 that tapers outwardly such that the inside diameter increases from about 0.352 inch to about 0.356 inch. The first inner portion 26 terminates at an inflection point 28 that identifies the beginning of a second interior portion 30 having a substantially constant diameter.

The transition portion 20 of the 9×23 mm cartridge casing 10 contains a circumferential extractor groove 32 that approaches the first portion 12 through a transition bevel having an angle, "α" of from 30° to 40° relative to a longitudinal axis 35 of the cartridge casing 10. The transition bevel 34 assists in the ejection of spent cartridges from the gun.

Figure 3:
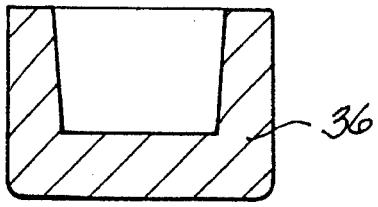
PRIOR ART FIG-3
FIGS. 3–5 illustrate the deep drawing of a 9 millimeter cartridge.

Manufacture of the 9×23 mm cartridge casing is illustrated in FIGS. 3–6. FIG. 3 illustrates a brass slug formed into a cup 36 having an outside diameter of about 0.5 inch and a height of about 0.5 inch. The cup 36 is annealed, typically at about 700° C. and then drawn for a first time A first intermediate structure 38 represents the cup 36 following a first drawing. The outside diameter is reduced to about 0.46 inches and the height is increased to about 0.66 inches. Following a second anneal at about 630° C., the first intermediate structure is drawn to form the second intermediate structure 40.

After a wash to remove oxides and lubricants, the second intermediate structure 40 is drawn to a near final shape 42. The outside diameter is about 0.388 inch. The height is about 0.975 inches and will be subsequently trimmed to a desired length, about 0.900 inch for a 9×23 mm casing. During the third drawing operation, the near final shape 42 is prone to fracture 44. The fracture propagates from the inflection point 28.

Figure 2:
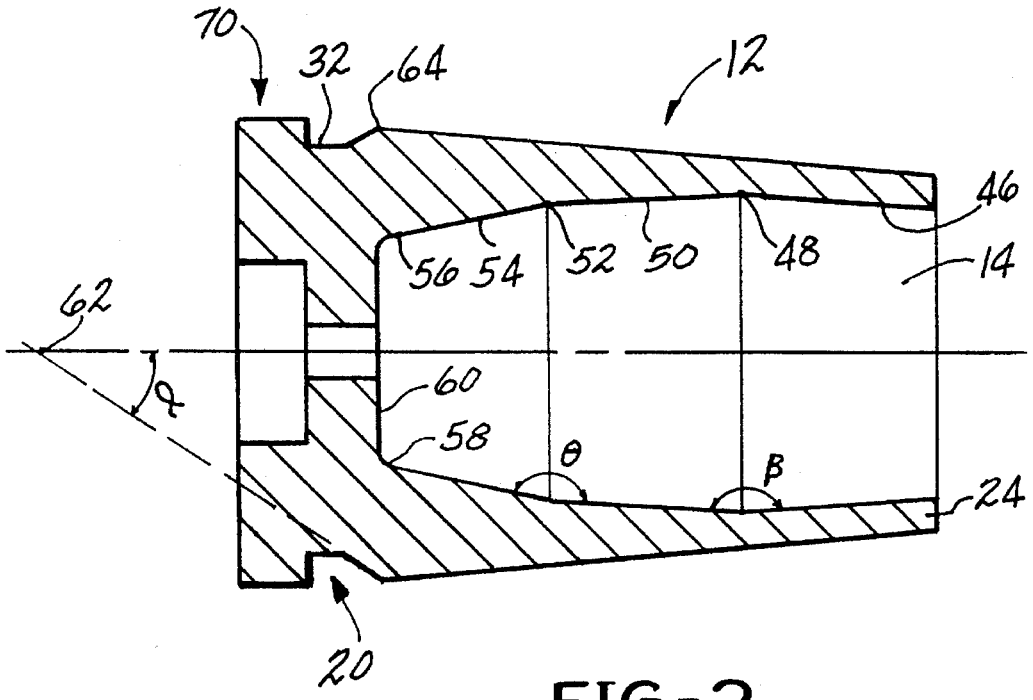
FIG. 2 shows in cross-sectional representation a 9 millimeter cartridge in accordance with the invention.

The fracture 44 is avoided by forming the first portion 12 as illustrated in FIG. 2. The first bore 14 has a first linear portion 46 extending from the opposing end 24 to a first inflection point 48. A second linear portion 50 extends from the first inflection point 48 to a second inflection point 52. A third linear portion 54 extends from the second inflection point to a third inflection point 56 and a fourth portion 58 extends between the third inflection 56 and a planar interior base 60 that is generally perpendicular to a longitudinal axis 62 of the cartridge case 70.

Figure 4:
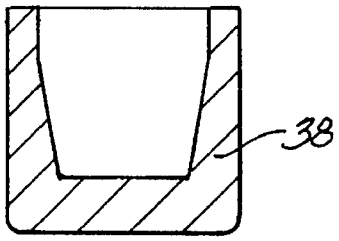
PRIOR ART FIG-4
Figure 5:
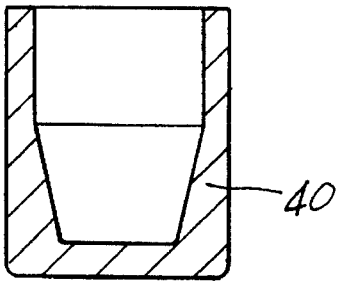
PRIOR ART FIG-5
Figure 6:
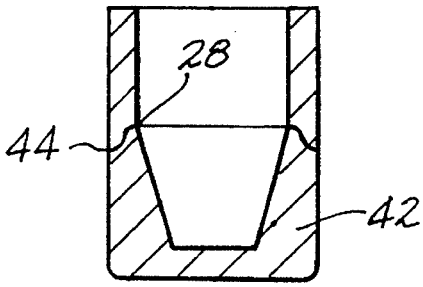
PRIOR ART FIG-6
FIG. 6 illustrates the fracture of a prior art 9 millimeter cartridge during deep drawing.
Figure 7:
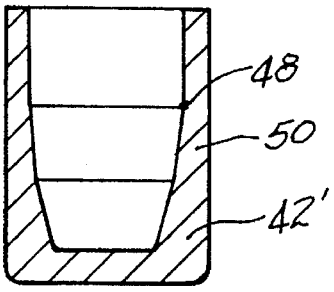
FIG. 7 illustrates the successful deep drawing of the 9 millimeter cartridge of the invention.

With reference to FIG. 7, when the cartridge case 70 is formed by deep drawing, as illustrated in FIGS. 3–5, the near final shape 42' does not fracture. The integrity of the near final shape 42' is believed to be the result of a gradual transition at the first inflection point 48 and a reduced metal thickness underlying the second linear portion 50.

With reference back to FIG. 2, the outside diameter of the 9×23 mm cartridge Case 70 continuously decreases at a constant rate from a maximum in the range of from about 0.384 inch to about 0.394 inch at a point 64 adjacent to the transition portion 20 to a minimum of from about 0.373 inch to about 0.383 inch at the opposing end 24.

The first linear portion 46 has a length of from about 0.225 inch to about 0.235 inch and a continuous wall thickness of approximately 0.010– 0.012 inch. The second linear portion 50 has a length of about 0.190 inch to about 0.210 inch and is tapered such that the wall thickness decreases from a maximum of 0.032 inch at the second inflection point 52 to 0.010 inch–0.012 inch at the first linear portion 46. The angle, β, formed between the first linear portion 46 and the second linear portion 50 is slightly less than 180° and is preferably on the order of from about 175° to about 179.5° and preferably from about 177° to about 179°.

The third linear portion 54 has a length of from about 0.210 inch to about 0.230 inch. The thickness of this third linear portion 54 decreases from about 0.1000 inch at the third inflection point 56 to a maximum of 0.032 inch at the second inflection point 52. The angle, Θ, between the second linear portion 52 and third linear portion 54 is from about 172° to about 179° and preferably from about 175° to about 177°.

The fourth portion 58 connects the third linear portion 54 to the planar base 60. The fourth portion 58 may be an arc, a linear projection or any other suitable shape. An arc is preferred to minimize stress at this fourth portion when the powder charge is ignited.

Another point of fracture during drawing of a 9×23 mm cartridge is the circumferential extractor groove 32. By maintaining α to less than about 28° and preferably in the range of from about 18° to about 28°, fracture at the circumferential extractor groove 32 is avoided during drawing of the cartridge casing 70. Most preferably, α is in the range of from about 22° to about 27°.

While the cartridge casing of the invention has been described in terms of a 9×23 mm cartridge casing, the concepts presented are suitable for other length 9 mm cartridge casings, as well as other caliber cartridge casings. The cartridge casings are suitable for all types of firearms, including but not limited to, revolvers, rifles, carbines, automatics and submachine guns.

It is apparent that there has been provided in accordance with the present invention a-cartridge casing having improved deep drawing capability that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. An increased length 9 mm cartridge casing comprising:

a deep drawn single piece of brass having a first portion for receiving both gun powder and a bullet, a second portion for receiving a primer charge and a transition portion disposed between said first portion and said second portion;

said first portion having an outside diameter that continuously decreases at a constant rate from a maximum adjacent to said transition portion to an opposing end of said first portion and an inner bore that contains, in cross section along a longitudinal axis, a first linear interior portion extending from said opposing end to a first inflection point, a second linear interior portion extending from said first inflection point to a second inflection point and forming an angle, β, with said first linear portion of from about 175° to about 179.5°, a third linear portion extending from said second inflection point to a third inflection point and forming an angle, Θ, with said second linear portion of from about 172° to about 179°, and a fourth arcuate portion extending from said third inflection point to a planar interior base that is generally perpendicular to a longitudinal axis of the cartridge, wherein the maximum thickness of said cartridge casing at said second inflection point is 0.032 inch;

said second portion having an interior chamber to receive a primer charge; and said transition portion having an internal channel extending from said first portion to said second portion, said internal channel located rearward of said planar interior base.

2. The cartridge casing of claim 1 wherein the length of said first linear portion is from about 0.225 inch to about 0.235 inch.

3. The cartridge casing of claim 2 wherein the length of said second linear interior portion is from about 0.190 inch to about 0.210 inch.

4. The cartridge casing of claim 3 wherein the length of said third linear interior portion from about 0.210 inch to about 0.230 inch.

5. The cartridge casing of claim 4 wherein said transition portion contains an extractor groove in an outside wall thereof, said extractor groove having a transition bevel adjacent to said first portion that forms an angle relative to a longitudinal axis of said cartridge casing of less than 28°.

6. The cartridge casing of claim 5 wherein said angle is from about 22° to about 27°.

7. The cartridge casing of claim 5 wherein said brass is an alloy of 30% zinc and 70% copper.

8. The cartridge casing of claim 1 wherein said transition portion contains an extractor groove in an outside wall thereof, said extractor groove having a transition bevel adjacent to said first portion that forms an angle relative to a longitudinal axis of said cartridge casing of less than 28°.

9. The cartridge casing of claim 8 wherein said angle is from about 22° to about 27°.

* * * * *

UNITED STATES PATENT AND TRADEMARK OFFICE
Certificate

Patent No. 5,507,232 Patented: April 16, 1996

On petition requesting issuance of a certificate for correction of inventorship pursuant to 35 U. S. C. 256, it has been found that the above-identified patent, through error and without deceptive intent, improperly sets forth the inventorship.

Accordingly, it is hereby certified that the correct inventorship of this patent is: Anthony F. Valdez and John A. Ricco, Sr.

Signed and Sealed this Seventh Day of October, 1997.

MICHAEL J. CARONE
*S.P.E.* Art Unit 2201
Patent Examining Group 2200
Special Laws Administration